US011041664B2

(12) United States Patent
Kusuda et al.

(10) Patent No.: US 11,041,664 B2
(45) Date of Patent: Jun. 22, 2021

(54) CONDENSER APPARATUS AND METHOD

(71) Applicant: The Boeing Company, Chicago, IL (US)

(72) Inventors: Charles Edward Kusuda, Mukilteo, WA (US); Arun Muley, San Pedro, CA (US)

(73) Assignee: The Boeing Company, Chicago, IL (US)

( * ) Notice: Subject to any disclaimer, the term of this patent is extended or adjusted under 35 U.S.C. 154(b) by 111 days.

(21) Appl. No.: 16/261,990

(22) Filed: Jan. 30, 2019

(65) Prior Publication Data

US 2019/0162456 A1 May 30, 2019

Related U.S. Application Data

(62) Division of application No. 14/675,115, filed on Mar. 31, 2015, now Pat. No. 10,222,106.

(51) Int. Cl.
*F25B 39/04* (2006.01)
*F28B 1/00* (2006.01)
(Continued)

(52) U.S. Cl.
CPC ..... *F25B 39/04* (2013.01); *F28B 1/00* (2013.01); *F28B 1/06* (2013.01); *F28D 1/05316* (2013.01);
(Continued)

(58) Field of Classification Search
CPC ... F25B 39/04; F28F 1/006; F28F 1/40; F28F 1/025; F28F 1/32; F28F 13/08; F28D 1/05316; F28D 1/05366
See application file for complete search history.

(56) References Cited

U.S. PATENT DOCUMENTS 1,844,308 A * 2/1932 Armacost ..... F28D 7/00 165/86
1,894,753 A 1/1933 Cahoon
(Continued)

FOREIGN PATENT DOCUMENTS

DE 1501484 A1 3/1976
DE 19521622 A1 12/1996
(Continued)

OTHER PUBLICATIONS

Chinese First Office Action dated Dec. 20, 2018 for Chinese Patent Application No. 2016101604686, 16 pages.
(Continued)

*Primary Examiner* — Jon T. Schermerhorn, Jr.
(74) *Attorney, Agent, or Firm* — Sage Patent Group

(57) ABSTRACT

A condenser having passages of varying geometry for cooling of fluid. The condenser apparatus includes substantially parallel tubes each defining a channel and having an inlet at a first end and an outlet at a second end, the first end having a greater hydraulic diameter than the second end. Inlet and outlet manifolds are provided. The tubes may be oriented substantially vertically with the inlets above the respective outlets. A heat exchanger core comprises the tubes and substantially horizontally oriented fin material connecting the tubes. The tubes may receive a relatively higher temperature vapor or vapor and liquid mixture into the inlets of the tubes, around the tubes coolant flows substantially horizontally to remove heat from the tubes, and relatively cooler saturated liquid is discharged from the outlets. In one embodiment, the tube's channel splits into multiple channels to reduce the hydraulic diameter and increase the surface area ratio.

20 Claims, 6 Drawing Sheets

(51) Int. Cl.

| | |
|---|---|
| ***F28D 1/053*** | (2006.01) |
| ***F28F 1/00*** | (2006.01) |
| ***F28F 1/02*** | (2006.01) |
| ***F28F 1/32*** | (2006.01) |
| ***F28F 13/08*** | (2006.01) |
| ***F28F 1/06*** | (2006.01) |
| ***F28B 1/06*** | (2006.01) |

(52) U.S. Cl.

CPC ..... *F28D 1/05366* (2013.01); *F28F 1/006* (2013.01); *F28F 1/025* (2013.01); *F28F 1/32* (2013.01); *F28F 13/08* (2013.01); *F25B 2339/04* (2013.01)

(56) References Cited

U.S. PATENT DOCUMENTS

| | | | | |
|---|---|---|---|---|
| 2,181,927 | A | 12/1939 | Townsend | |
| 3,315,466 | A | 4/1967 | Anderson | |
| 3,333,123 | A | 7/1967 | Baumann | |
| 4,763,725 | A | 8/1988 | Longsworth et al. | |
| 6,263,955 | B1 * | 7/2001 | Azar | F28F 3/02 165/80.3 |
| 7,367,385 | B1 * | 5/2008 | Materna | F28F 1/025 165/146 |
| 7,401,643 | B2 | 7/2008 | Queheillalt et al. | |
| 7,673,468 | B2 | 3/2010 | Bhatti et al. | |
| 8,573,289 | B1 | 11/2013 | Roper et al. | |
| 9,313,920 | B2 | 4/2016 | Campbell et al. | |
| 9,414,525 | B2 * | 8/2016 | Campbell | H05K 7/2039 |
| 9,439,325 | B2 * | 9/2016 | Campbell | H05K 7/20772 |
| 9,453,604 | B1 | 9/2016 | Maloney et al. | |
| 9,526,191 | B2 * | 12/2016 | Straznicky | H05K 7/20563 |
| 2004/0134226 | A1 | 7/2004 | Kraay et al. | |
| 2008/0072614 | A1 | 3/2008 | Bhatti et al. | |
| 2009/0183862 | A1 | 7/2009 | Benezech et al. | |
| 2010/0139631 | A1 * | 6/2010 | Geskes | F28F 3/042 123/568.12 |
| 2010/0236759 | A1 | 9/2010 | Wadley et al. | |
| 2014/0102134 | A1 | 4/2014 | Daly et al. | |
| 2014/0251585 | A1 | 9/2014 | Kusuda et al. | |

FOREIGN PATENT DOCUMENTS

| | | |
|---|---|---|
| EP | 0229666 A | 7/1987 |
| EP | 3315466 A | 5/2018 |

OTHER PUBLICATIONS

Brazilian Preliminary Office Action dated Feb. 25, 2021 for Brazilian Patent Application No. BR102016006806-1, 6 pages (including English translation).

Maloney, Kevin J., et al.; "Multifunctional heat exchangers derived from three-dimensional micro-lattice structures," International Journal of Heat and Mass Transfer, 2012, pp. 2486-2493, vol. 55.

Matos, R.S., et al.; "Optimally staggered finned circular and elliptic tubes in forced convection," International Journal of Heat and Mass Transfer, 2004, pp. 1347-1359, vol. 47.

Shah, Ramesh K., et al.; "Classification of Heat Exchangers," Fundamentals of Heat Exchanger Design, 2003, Chapter 1, pp. 1-77 (included is the Title Page and Copyright Page for a total of 79 pages).

European Patent Office; Extended European Search Report for European Patent Application No. 16158354.7 dated Oct. 5, 2016, 7 Pages.

* cited by examiner

CONDENSER APPARATUS AND METHOD

CROSS-REFERENCE TO RELATED APPLICATIONS

This application is a divisional of U.S. patent application Ser. No. 14/675,115, filed Mar. 31, 2015, now U.S. Pat. No. 10,222,106, issued Mar. 5, 2019, entitled "Condenser Apparatus and Method," which is assigned to the same assignee as the present application and is incorporated herein in its entirety by reference.

FIELD

The present disclosure relates to heat transfer, and more particularly to condensers for cooling and converting hot vapor, or vapor and liquid mixtures, to liquids.

BACKGROUND

Condensers are heat exchangers that convert hot vapor, or high quality vapor/liquid mixtures, to liquids, by transferring heat from the hot vapor or vapor/liquid mixture to the adjacent cooler fluid flows. As heat is removed from the vapor or high quality vapor/liquid mixture, its liquid content increases, resulting in density increases. As the liquid content increases, the associated hot side heat transfer coefficients increase, but the heat transfer coefficient on the cold side has not increased as much.

Conventional condenser designs may include constant cross-sectional areas for both hot and cold flows. The resulting design may yield surface areas inadequate for heat transfer near the entrance of the hot vapor or vapor/liquid mixture, and excess heat transfer surface areas in the mid and lower sections in which the liquid content is greater. The regions of excess heat transfer areas on the hot side correspond to areas of inadequate heat transfer area on the cold side, and the overall heat exchanger design may be an oversized and excessively heavy compromise.

SUMMARY

In accordance with an embodiment disclosed herein, a condenser apparatus is provided that may include a plurality of substantially parallel tubes, each tube defining a channel and having an inlet at a first end and an outlet at a second end, the first end having a greater hydraulic diameter than the second end. An inlet manifold may be provided at the inlets of the tubes for distributing flow to the inlets, and an outlet manifold may be provided at the outlets of the tubes for receiving flow from the outlets.

In some embodiments in combination with the above embodiment, the tubes may each have a longitudinal axis, and the longitudinal axes may be oriented substantially vertically. In some embodiments in combination with the above embodiment, the condenser apparatus includes a heat exchanger that includes a heat exchanger core, and the heat exchanger core may include the tubes and fin material connecting the tubes. In some embodiments in combination with the above embodiment, the tubes may each have a longitudinal axis where the longitudinal axes may be oriented substantially vertically with the inlets above the respective outlets, and the condenser apparatus further includes a heat exchanger core, wherein the heat exchanger core may include the tubes and substantially horizontally oriented fin material connecting the tubes.

In some embodiments in combination with the above embodiment, the heat exchanger core may be configured such that the tubes receive a relatively higher temperature vapor or vapor and liquid mixture into the inlets of the tubes. Coolant may flow around the tubes substantially horizontally to remove heat from the tubes, and a relatively cooler saturated liquid may be discharged from the outlets. In some such embodiments, the heat exchanger core may be configured at a lowest section of the tubes to cool the liquid to a subcooled state.

In some embodiments in combination with any of the above embodiments, each tube may include a longitudinal axis and a length, and may include at least one portion along the length that tapers from a first hydraulic diameter to a second hydraulic diameter that is less than the first hydraulic diameter. In some such embodiments, each tube may include a wall. The wall at a first portion of the wall of the tube may be parallel to the longitudinal axis. A second portion of the tube is longitudinally adjacent to the first portion and the wall at the second portion may be tapered or may have a gradually decreasing hydraulic diameter. A third portion of the tube is longitudinally adjacent to the second portion and the wall at the third portion may be parallel to the longitudinal axis, wherein the hydraulic diameter of the tube is smaller at the third portion than at the first portion.

In some embodiments in combination with any of the above embodiments, a cross-section of each tube may be circular. In some embodiments in combination with any of the above embodiments, a cross-section of each tube may be elliptical, oval, wing-shaped or any other shape that may efficiently transfer heat.

In accordance with another embodiment disclosed herein, a condenser apparatus is provided that includes a plurality of substantially parallel tubes, each tube having an inlet at a first end and an outlet at a second end. The first end defines a channel and the second end defines a plurality of channels, with the first channel splitting into the plurality of channels between the first and the second end and the first end having a greater hydraulic diameter than the second end. An inlet manifold is provided at the inlets of the tubes for distributing flow to the inlets, and an outlet manifold is provided at the outlets of the tubes for receiving flow from the outlets.

In some embodiments in combination with the above embodiment, the tubes each have a longitudinal axis, and the longitudinal axes are oriented substantially vertically. In some embodiments in combination with the above embodiment, the condenser apparatus includes a heat exchanger that includes a heat exchanger core, and the heat exchanger core includes tubes and fin material connecting the tubes. In some embodiments in combination with the above embodiment, the tubes each have a longitudinal axis where the longitudinal axes are oriented substantially vertically with the inlets above the respective outlets, and the condenser apparatus further includes a heat exchanger core, wherein the heat exchanger core comprises the tubes and substantially horizontally oriented fin material connecting the tubes.

In some embodiments in combination with the above embodiment, the heat exchanger core is configured such that the tubes receive a relatively higher temperature vapor or vapor and liquid mixture into the inlets of the tubes, around the tubes coolant flows substantially horizontally to remove heat from the tubes, and relatively cooler saturated liquid is discharged from the outlets. In some such embodiments, the heat exchanger core is configured at a lowest section of the tubes to cool the liquid to a subcooled state. In some embodiments in combination with any of the above embodiments, a cross-section of each tube is elliptical.

In accordance with another embodiment disclosed herein, a method of condensing a hot vapor or vapor and liquid mixture to a liquid is provided. The method includes discharging a relatively higher temperature vapor or vapor and liquid mixture flow from an inlet manifold and into a plurality of substantially parallel tubes, with each tube defining a channel and having an inlet at a first end and an outlet at a second end. The first end has a greater hydraulic diameter than the second end. The relatively higher temperature vapor or vapor and liquid mixture is caused to flow through the tubes and to condense to be saturated liquid. The saturated liquid is received in an outlet manifold at the outlets of the tubes.

In accordance with the above embodiment, the saturated liquid is subcooled prior to discharge through the manifold. In some embodiments in combination with any of the above embodiments, the relatively higher temperature vapor or vapor and liquid mixture is caused to flow through the tubes and to condense to be saturated liquid comprises causing flow through periodically or continuously decreasing hydraulic diameters of each tube as the flow advances from the inlet to the outlet with associated relative increases in surface area of the tube and heat transfer rates.

Other aspects and features of the present disclosure, as defined solely by the claims, will become apparent to those ordinarily skilled in the art upon review of the following non-limited detailed description of the disclosure in conjunction with the accompanying figures.

BRIEF DESCRIPTION OF THE DRAWINGS

The following detailed description of embodiments refers to the accompanying drawings, which illustrate specific embodiments of the disclosure. Other embodiments having different structures and operations do not depart from the scope of the present disclosure.

DESCRIPTION

Figure 1:
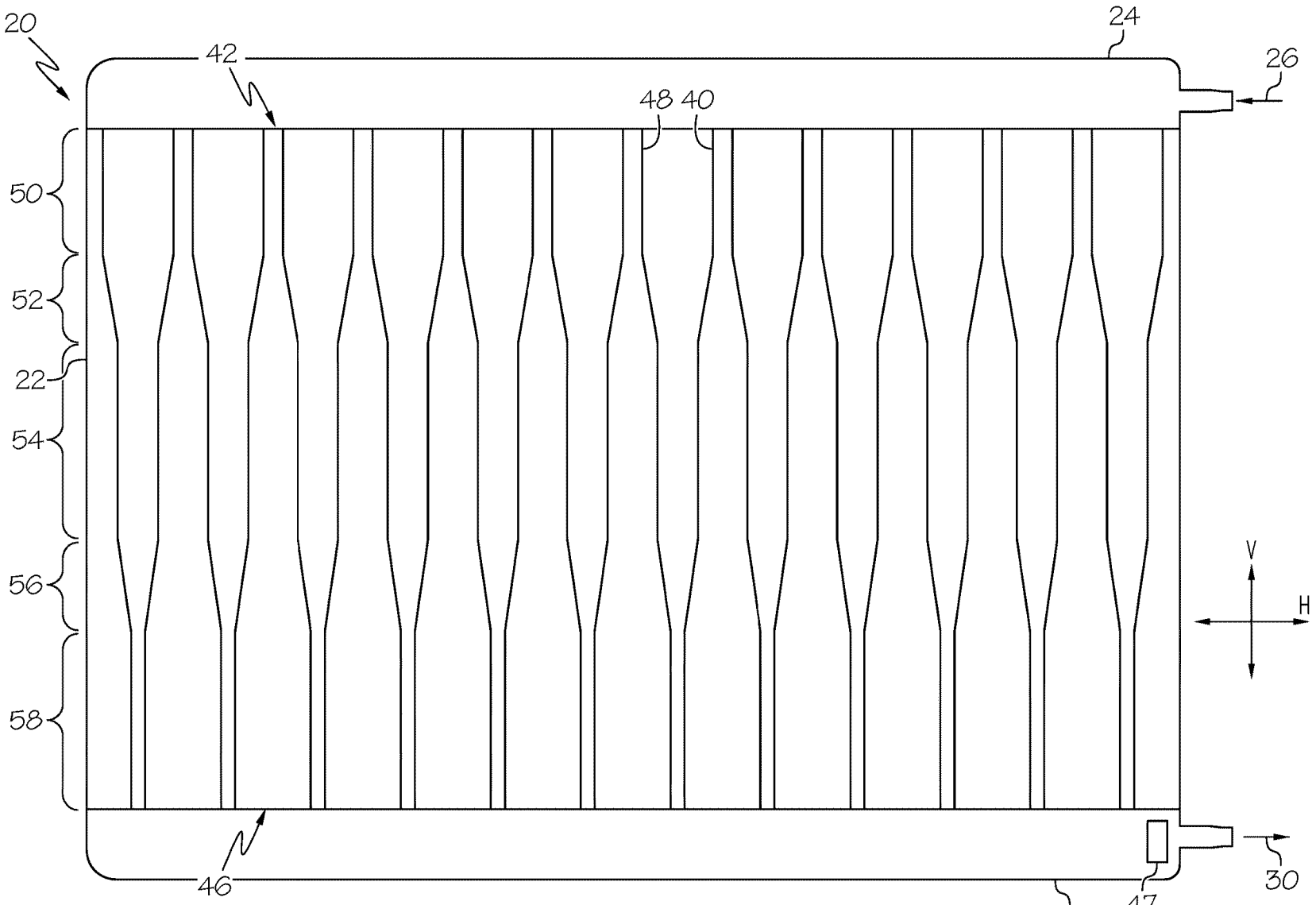
FIG. 1 is a cross-sectional view of an example of a condenser apparatus in accordance with an embodiment of the present disclosure.

The following detailed description of embodiments refers to the accompanying drawings, which illustrate specific embodiments of the disclosure. Other embodiments having different structures and operations do not depart from the scope of the present disclosure Like reference numerals may refer to the same element or component in the different drawings.

Certain terminology is used herein for convenience only and is not to be taken as a limitation on the embodiments described. For example, words such as "proximal", "distal", "top", "bottom", "upper," "lower," "left," "right," "horizontal," "vertical," "upward," and "downward" merely describe the configuration shown in the figures or relative positions. The referenced components may be oriented in any direction and the terminology, therefore, should be understood as encompassing such variations unless specified otherwise.

Many conventional condensers have fluid passages of constant cross-sectional area for the hot fluid flows. The cross-sectional area on the hot side is chosen to meet a pressure drop requirement associated with a prescribed mass flow. At the top, this results in a resistance to flow as the higher quality, low density mixture is forced into small passages at higher velocities, resulting in higher pressure drops. Transitioning to the mid-section, surface area to fluid volume is more optimized to the mid quality and density mixture, but heat transfer surface area on the cold side is lacking. Near the bottom, where the mixture is at its highest density and lowest quality, the fluid passages are too large for the condensed liquids and, still too small for the cold side, thus requiring additional flow length to accomplish the desired cooling. Where the surface areas of passages decrease, addition of fin material results in increased surface areas for heat transfer. Ideally, a heat exchanger is designed to have equal heat transfer capability on the hot and cold sides. For a condenser, the heat transfer is affected by convection coefficient, area, and difference in temperature (delta T) between a surface and surrounding fluid. In the upper sections, the high quality vapor has a higher convection coefficient, but the delta T helps the heat transfer as well. High liquid content drives a higher heat transfer coefficient, which can be balanced by more fin area on the cold flow side. Similarly in the lowest section, additional fin area with lower delta T enables better subcooling.

The apparatus described herein may provide variations of the available cross-sectional areas in the passages for the hot vapor or vapor/liquid mixture flows in a condenser, with variation of the liquid content. The gradual reduction in the hot side passage hydraulic diameters may enable increased surface areas for the associated cold side flows resulting in higher heat transfer rates. Reduced diameter passages optimized for liquid flows near the hot side exit may enhance the bottom to top pressure gradient and hot side mass flows. Geometric reduction of the hot flow passages' cross-sectional areas, by reduction to or division into many smaller passages, results in cross-sectional and surface area changes, and may provide designs with more optimal pressure drop and heat transfer. Optimized passages for the liquid condensate may enable subcooling of the liquid as well as improved overall mass flow on the hot side. The additional cooling of the saturated liquid, resulting in subcooled condensate can mitigate pump cavitation issues in the condensate reservoir. Fins can be added internally and externally to larger diameter passages to increase heat transfer surface areas, but may not be necessary in smaller diameter passages.

Figure 2:
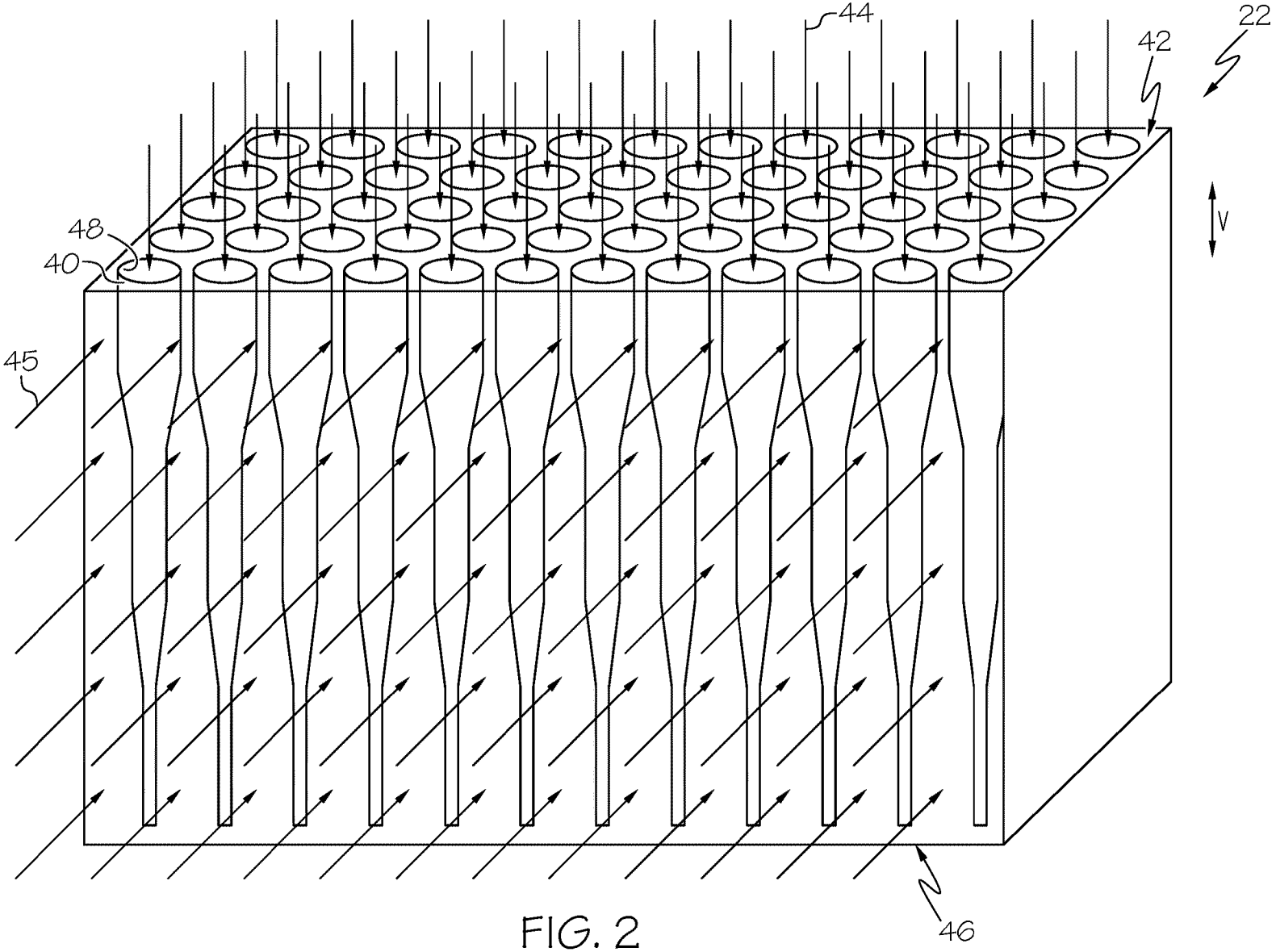
FIG. 2 is a perspective view of the exemplary condenser apparatus of FIG. 1.

FIGS. 1 and 2 show an example of a condenser apparatus 20 in accordance with an embodiment of the present disclosure that includes a heat exchanger including a heat exchanger core 22 between an inlet manifold 24, for receiving flow 26 into the condenser 20, and an outlet manifold 28, for discharging flow 30 out of the condenser 20. The outlet manifold 28 may also be referred to as a reservoir or condensate reservoir. The core 22 includes a matrix of substantially vertically (V) oriented tapering tubes 40 that may be connected by horizontally (H) oriented fin material (see example in FIGS. 5 and 6). The vertically oriented tapering tubes 40 may be connected to the inlet manifold 24 at the top 42 of the core 22, into which the hot (relatively higher) vapor or vapor and liquid mixture, referred to in the following discussion as the "vapor/liquid mixture," may be injected 44 (FIG. 2). The vapor/liquid mixture may then be distributed in the matrix of vertically oriented tapering tubes 40, and a downward flow may then be established. Around the vertical tubing 40, horizontal coolant flow 45 (e.g. cool liquid or air) may be established to remove heat from the vertically oriented tapered tubing 40. As heat is removed from the vapor/liquid mixture, it cools and its density increases, therefore allowing a reduction in cross-sectional area of the tubing 40 without an increase in fluid velocity and pressure drop. As the vapor/liquid mixture cools, more and more liquid condenses from the mixture, until at the bottom 46 of the heat exchanger core 22, it is saturated liquid. As the temperature difference between the coolant and condensate diminishes, the heat transfer rate will also be reduced. An optimal configuration may result in columns of liquid condensate filling the lowest portions of the core 22 or tubes 40, with few gaseous voids, so that the downward flow in each tube 40 creates a relative vacuum in the preceding tube section and an overall greater hot flow rate through the condenser 20. The columns of condensate, continuing into the return manifold or reservoir 28 also serve to increase the pressure within the reservoir 28, beyond saturation pressure, thereby mitigating cavitation in a pump 47 which may be submerged in the reservoir 28 or manifold. Cavitation is a common problem in two-phase cooling systems.

The tubes 40 may each define a channel 48 and are shown as being circular in cross-section, but any number of other shapes may be used. For comparison purposes, hydraulic diameters may be referred to, in that a cross-section of any shape may be calculated as having an equivalent hydraulic diameter as if the shape were circular in cross-section; for a circular cross-section shape, the actual diameter is the hydraulic diameter.

As shown in the embodiment of the condenser apparatus 20 of FIGS. 1 and 2, there may be five sections in each tube. Starting from the top 42 of the core 22, the inlet or first section 50 has the greatest hydraulic diameter and a straight wall, that is, a wall that is perpendicular to the longitudinal axis of the tube 40. A second section 52 is tapered, and reduces the hydraulic diameter to the third section 54, which has straight walls. A fourth section 56 extends from the third section 54 and tapers the hydraulic diameter to the outlet or fifth section 58, which is the lowest section and has straight walls. Although the tubing 40 is shown as having three straight sections 50, 54, 58 with tapered sections 52, 56 interposed therebetween, any number of combinations of straight and tapered wall sections could be used while taking advantage of decreasing cross-sectional area to increase the proportion of surface area of the tubing. An ideal width of the smallest diameter section or fifth section 58 would allow for optimal condensate velocity, while the column of liquid's meniscus occupies the entire cross-sectional area. Then the downward movement of the liquid column results in a negative pressure in the preceding sections and improved downward flow. This geometry directly links the condensate pump pressure to the condenser's internal pressure gradient, thereby improving hot flows.

Tapering of the tubes 40 refers to a reduction of the diameter of a circular cross-section tube, or in general to a reduction in the hydraulic diameter of a tube of any shape, in general. With a taper, the reduction in hydraulic diameter may be achieve by a reduction in the cross-sectional area of the tube 40 along the longitudinal axis of the tube 40, where the wall of the tube 40 between the start of the taper and the end of the taper is straight along the longitudinal axis, or the wall may be curved along a line parallel to the longitudinal axis, until reaching the end of the taper. At the start of the reduction, the taper of the tube 40 and hydraulic diameter of the tube 40 is greater than at the end of the taper (at a lower position in the embodiment shown). Where the taper is provided by a straight tube wall, there may be break points where there is a distinct angle in the tube wall. The taper may also be along a smooth curve, or with a combination of a straight wall and a curved profile. Although the depicted gradual tapering may be desirable, other configurations such as different diameter straight wall tubes, or tubes with a continuous taper for the length of the tube, may be used to reduce the cross-sectional area when advancing downward.

The outlet or lowest section of the vertically oriented tubing 40, being the fifth section 58 in the exemplary embodiment of FIGS. 1 and 2, in particular may allow for cooling of the saturated liquid to a subcooled state. The subcooled liquid condensate can then be dumped directly into a reservoir 28 from which the pump 47 draws the fluid and supplies it to another part of the cooling system where cooling of hot components results in revaporization of the coolant. Subcooling the liquid and/or additional head provided by the column of condensate in each tube 40 may prevent cavitation in the pump 47 and loss of cooling fluid to the cooling system. In some two-phase systems it may be desirable to deliver the condensate as close to saturation as possible to preclude cavitation in the pump 47. The head associated with the column of liquid condensate may be the dominant mechanism of increasing the pressure and precluding cavitation.

Figure 3:
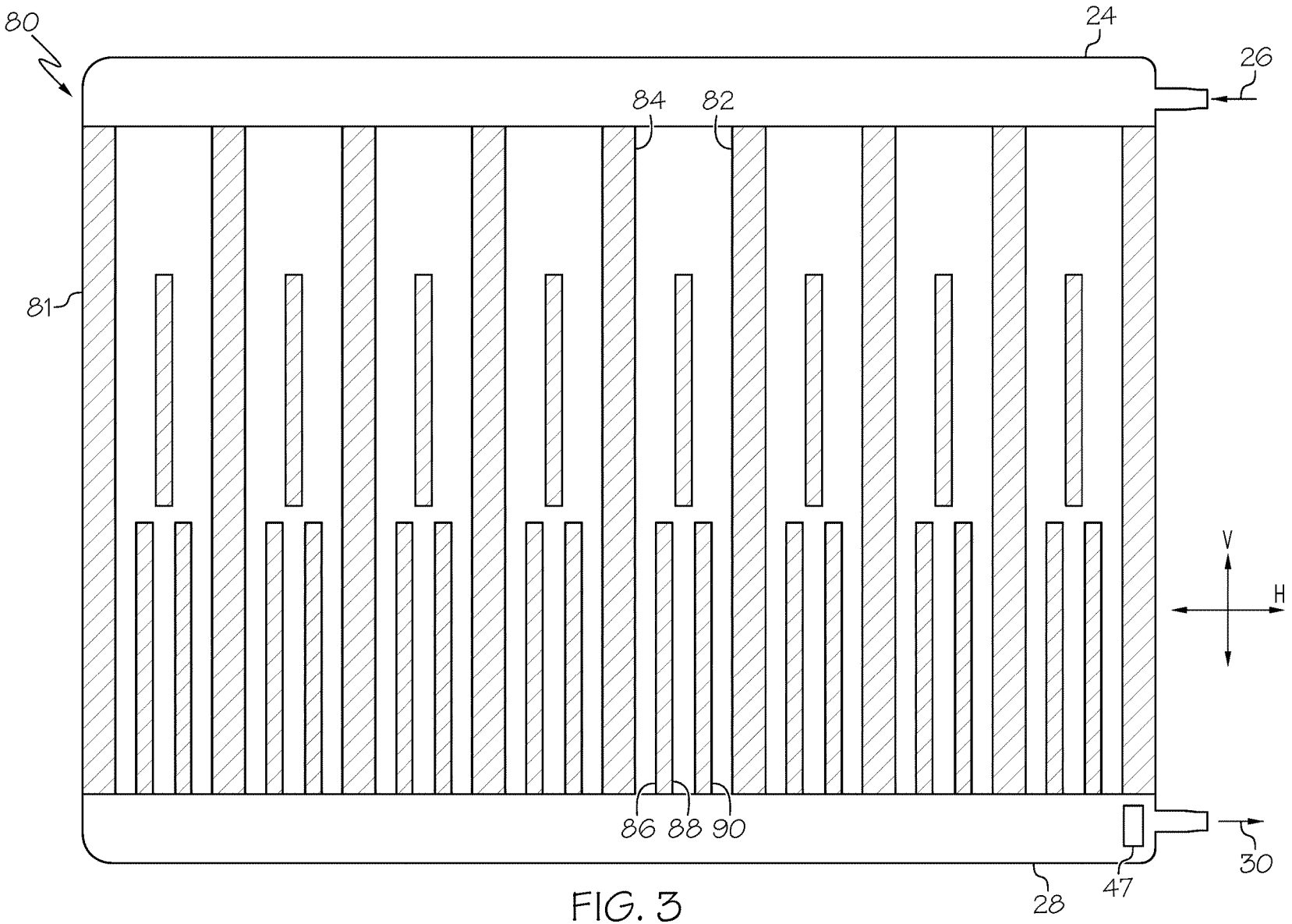
FIG. 3 is a cross-sectional view of an exemplary condenser apparatus in accordance with another embodiment of the present disclosure.
Figure 4:
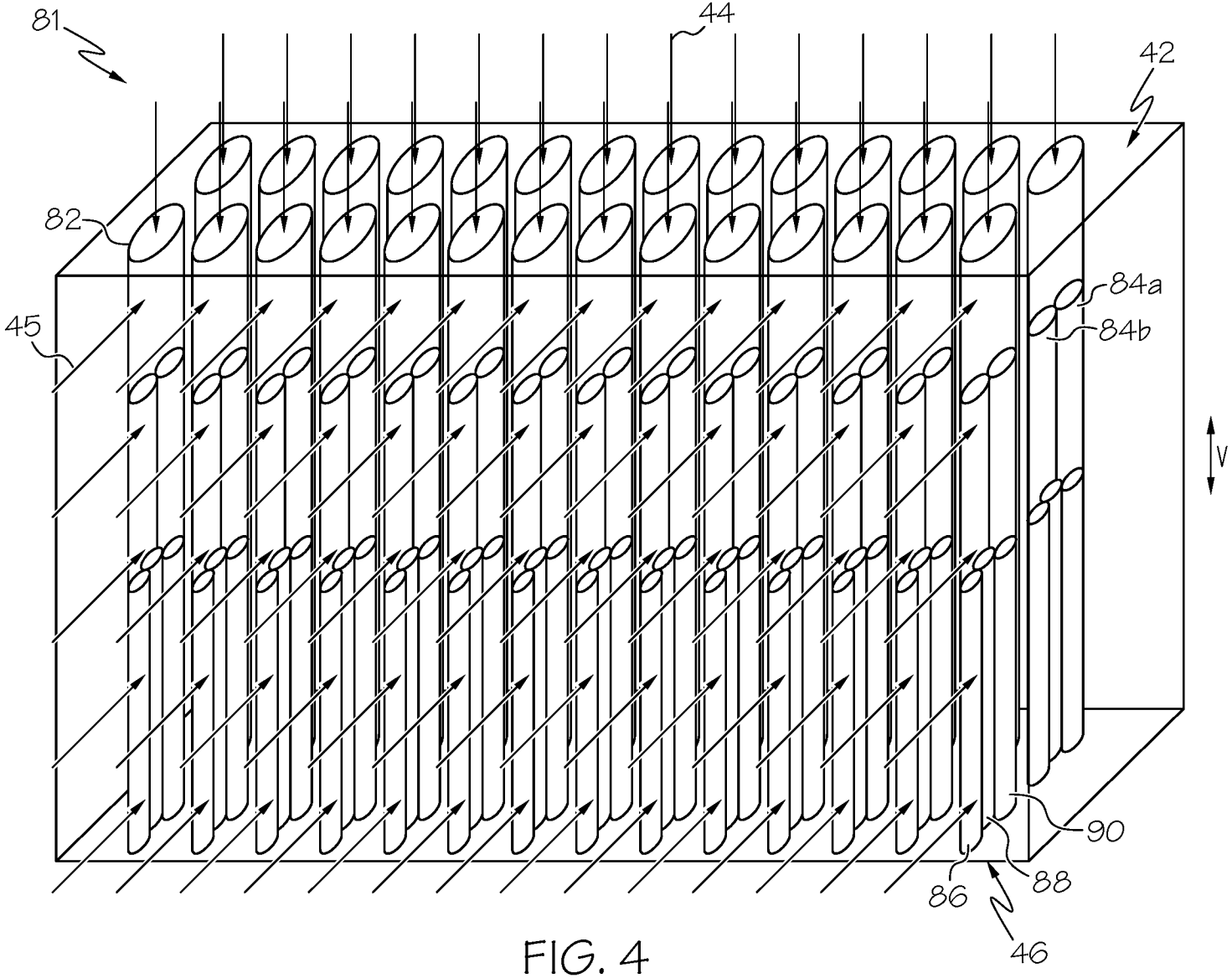
FIG. 4 is a perspective view of the exemplary condenser apparatus of FIG. 3.

FIGS. 3 and 4 depict an example of a condenser 80 with a heat exchanger including a heat exchanger core 81 in accordance with another embodiment of the disclosure. Once again, a matrix of tubes 82 is provided. Instead of the tapering used in the first embodiment, reductions in cross-sectional area are accomplished by splitting of the channel 84 defined by each tube 82 into a plurality of channels of reduced hydraulic diameter. In this embodiment, the tube 82 is split into three channels 86, 88, 90, but other numbers of channels are possible. Splitting an upper portion of the channel 84 in a first channel section 84*a* and second channel section 84*b* may result in better usage of the volumes in the core 81, particularly with respect to the flow 45 of the coolant.

The relative positions of structures or tubes 82 can be arranged to optimize the cooling and/or manage the cold flow's pressure drop. For example, in FIG. 4, the second row of tubes 82 may be aligned with the spacing between the tubes 82 of the first row. In this configuration more direct impingement and greater cooling may occur. Similarly, in other embodiments with multiple rows of tubes, each row of may be aligned with the spacing between the tubes of the preceding or adjacent row. This may pertain to adjacent tubes, whether or not they are from separate larger diameter tubes or from the same larger diameter tube.

While circular cross-section tubes could be used in this second embodiment, elliptical cross-section tubing may be provided as shown to result in a greater surface area to cross-sectional area ratio, which promotes heat transfer and reduces resistance to and pressure drop in the horizontal coolant flow, thereby reducing power consumption of the coolant pump 47 or fan.

Figure 5:
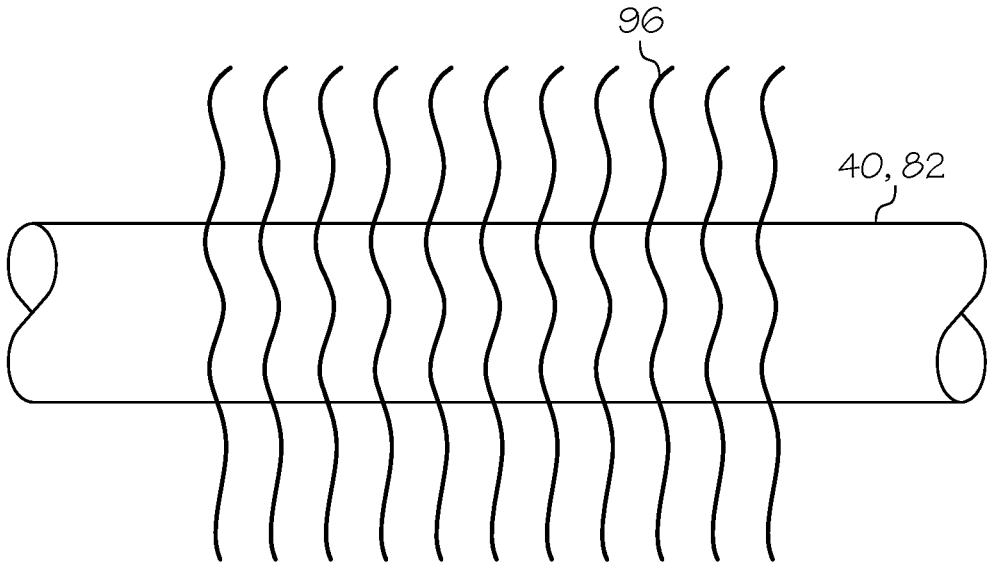
FIGS. 5 and 6 are side elevation and views, respectively, of an example of fins on a tube of a condenser apparatus in accordance with an embodiment of the present disclosure.
Figure 6:
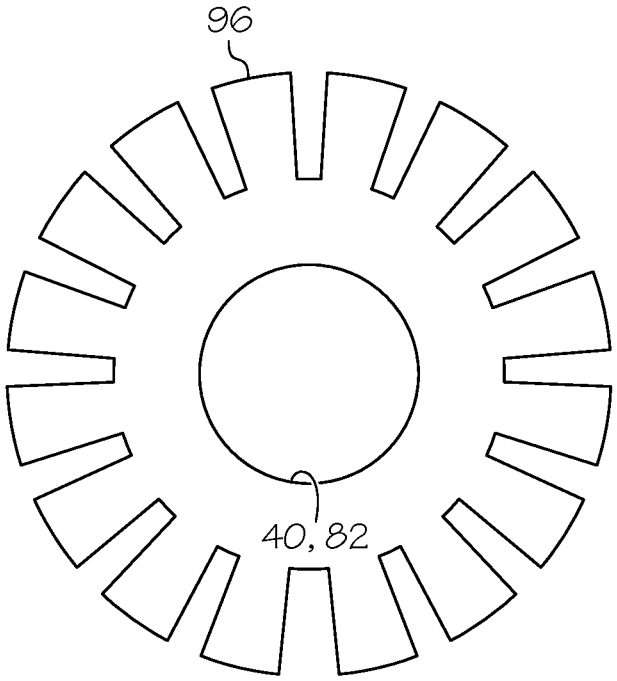

FIGS. 5 and 6 show detail of fins or fin material 96 that may be used on a tube of a condenser, such as tubes 40, 82 in accordance with an embodiment of the present disclosure. The fins or fin material 96 in this embodiment are shown to be partially cut and on a helix pattern around the tube 40, 82. Different designs of fins or fin material 96 may be selected, depending on such factors as the heat transfer requirements, space availability in the core, and dimensions of the tubing. The fins or fin material 96 may be used to divert more cold air to regions of higher temperature in the core 22, 81. As heat transfer is a function of convection coefficient, area, and temperature change delta T (dT). The guidance of cold flow to hotter areas could be used to optimize heat transfer according to the equation: Q=H*A*dT, where H is the convection coefficient, A is the area and dT is the change in temperature.

Figure 7:
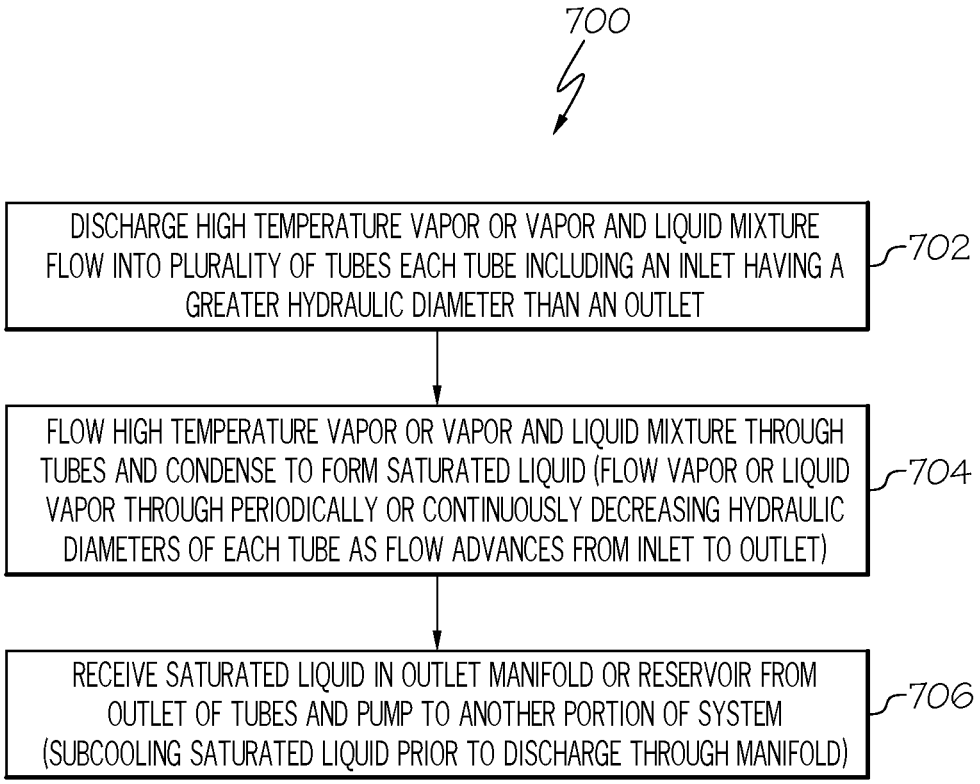
FIG. 7 is a flow chart of an example a method for condensing a hot vapor or vapor and liquid mixture in accordance with an embodiment of the disclosure.

FIG. 7 is a flow chart of an example a method 700 for condensing a hot vapor or vapor and liquid mixture in accordance with an embodiment of the disclosure. In block 702, a relatively higher temperature vapor or vapor and liquid mixture flow may be discharged from an inlet manifold and into a plurality of substantially parallel tubes. Each tube may define a channel and may include an inlet at a first end and an outlet at a second end. The first end may have a greater hydraulic diameter than the second end.

In block 704, the relatively higher temperature vapor or vapor and liquid mixture is directed to flow through the tubes and to condense to be saturated liquid. Similar to that described herein, each of the tubes may include a periodically or continuously decreasing hydraulic diameter as flow advances from the inlet to the outlet.

In block 706, the saturated liquid may be received in an outlet manifold or reservoir disposed at the outlets of the tubes and may be pumped to another portion of the system. The saturated liquid may be subcooled prior to discharge through the manifold.

As disclosed herein, in some embodiments geometric variation of fluid passages according to liquid content of the hot side flows may result in optimized heat transfer in reduced envelopes. Cross-sectional geometric variations enable increased perimeter per internal unit area which translates to greater heat transfer surface area per unit volume as a shape deviates from circular. This enables more of the hot flow to be exposed to heat transfer surfaces more often, thereby enabling greater temperature change ($\Delta T$) between hot and cold flows. Passages in some embodiments that are optimized for liquid flows near the exit of the hot flow passages may enable improved cooling of the liquid condensate, allowing flow velocities to be increased, which enhances top to bottom pressure gradient and hot side mass flow. More surface area for the cold flows may enable a better balance between potential hot and cold heat transfer rates. The overall condenser design may be smaller and lighter than a convention condenser.

The terminology used herein is for the purpose of describing particular embodiments only and is not intended to be limiting of the disclosure. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Although specific embodiments have been illustrated and described herein, those of ordinary skill in the art appreciate that any arrangement which is calculated to achieve the same purpose may be substituted for the specific embodiments shown and that the embodiments herein have other applications in other environments. This application is intended to cover any adaptations or variations of the present disclosure. The following claims are in no way intended to limit the scope of the disclosure to the specific embodiments described herein.

What is claimed is:

1. A condenser apparatus, comprising:

a plurality of substantially parallel tubes, each tube having an inlet at a first end and an outlet at a second end, the first end defining a first channel and the second end defining a plurality of channels, with the first channel splitting into the plurality of channels between the first end and the second end, the first end having a greater hydraulic diameter than the second end;

an inlet manifold at the inlets of the tubes for distributing flow to the inlets; and an outlet manifold at the outlets of the tubes for receiving flow from the outlets.

2. The condenser apparatus of claim 1, wherein the tubes each have a longitudinal axis, and the longitudinal axes are oriented substantially vertically.

3. The condenser apparatus of claim 1, comprising a heat exchanger core, and the heat exchanger core comprises the tubes and fins connected to the tubes.

4. The condenser apparatus of claim 1, wherein the tubes each have a longitudinal axis, the longitudinal axes are oriented substantially vertically with the inlets above the respective outlets, and further comprising a heat exchanger core, wherein the heat exchanger core comprises the tubes and substantially horizontally oriented fin material connecting the tubes.

5. The condenser apparatus of claim 1 further comprising a heat exchanger, wherein the heat exchanger comprises a heat exchanger core configured such that the tubes receive a relatively higher temperature vapor or vapor and liquid mixture into the inlets of the tubes, the condenser apparatus further comprising a coolant that flows around the tubes to remove heat from the tubes, and a relatively cooler saturated liquid is discharged from the outlets.

6. The condenser apparatus of claim 5, wherein the heat exchanger core is configured at a lowest section of the tubes to cool the liquid to a subcooled state.

7. The condenser apparatus of claim 1, wherein a cross-section of each tube is elliptical.

8. The condenser apparatus of claim 1, wherein a cross-section of each tube is a shape other than circular.

9. The condenser apparatus of claim 1, wherein a cross-section of each tube is circular.

10. The condenser apparatus of claim 1, further comprising fins connected to the tubes.

11. The condenser apparatus of claim 10, wherein each of the fins comprise a plurality of notches.

12. The condenser apparatus of claim 1, further comprising a coolant flowing around the tubes to remove heat from the tubes.

13. The condenser apparatus of claim 12, wherein the coolant comprises a liquid or air.

14. The condenser apparatus of claim 1, further comprising a pump located in the outlet manifold.

15. A condenser apparatus, comprising:

a heat exchanger comprising a heat exchanger core, the heat exchanger core comprising a plurality of substantially parallel tubes, each tube having an inlet at a first end and an outlet at a second end, the first end defining a first channel and the second end defining a plurality of channels, with the first channel splitting into the plurality of channels between the first end and the second end, the first end having a greater hydraulic diameter than the second end;

an inlet manifold, the inlet of each of the tubes connected to the inlet manifold, the inlet manifold configured to receive a fluid into the condenser apparatus and then distribute the fluid to each of the tubes at the inlets; and an outlet manifold, the outlet of each of the tubes connected to the outlet manifold, the outlet manifold configured to receive the fluid from each of the tubes at the outlets and then discharged the fluid from the condenser apparatus.

16. The condenser apparatus of claim 15, wherein the heat exchanger core is configured such that the tubes receive a vapor or vapor and liquid mixture into the inlets of the tubes and a saturated liquid is discharged from the outlets of the tubes.

17. The condenser apparatus of claim 16, wherein the saturated liquid is subcooled prior to discharge through the outlet manifold to prevent cavitation of a pump.

18. A method of condensing a hot vapor or vapor and liquid mixture to a liquid, the method comprising:

discharging a relatively higher temperature vapor or vapor and liquid mixture flow from an inlet manifold and into a plurality of substantially parallel tubes, each tube having an inlet at a first end and an outlet at a second end, wherein the inlet manifold is at the inlets of the tubes for distributing flow to the inlets and the first end of each tube defining a first channel and the second end of each tube defining a plurality of channels, with the first channel splitting into the plurality of channels between the first end and the second end, the first end having a greater hydraulic diameter than the second end;

causing the relatively higher temperature vapor or vapor and liquid mixture to flow through the tubes and to condense to be saturated liquid; and receiving the saturated liquid in an outlet manifold at the outlets of the tubes.

19. The method of claim 18, further comprising subcooling the saturated liquid prior to discharge through the outlet manifold.

20. The method of claim 18, wherein causing the relatively higher temperature vapor or vapor and liquid mixture to flow through the tubes and to condense to be saturated liquid comprises causing flow through periodically or continuously decreasing hydraulic diameters of each tube as the flow advances from the inlet to the outlet with associated relative increases in surface area of the tube and heat transfer rates.

* * * * *